US005404705A

United States Patent [19]

Yanagihara et al.

[11] Patent Number: 5,404,705

[45] Date of Patent: Apr. 11, 1995

[54] APPARATUS FOR HEAT TREATING A SYNTHETIC YARN DURING FALSE-TWIST TEXTURING

[75] Inventors: Masaaki Yanagihara; Kenji Kawakami; Hiroyuki Nagai; Akira Miyamoto; Fumio Tanae; Shunzo Naito, all of Matsuyama, Japan

[73] Assignees: Teijin Seiki Co., Ltd.; Teijin Limited, both of Osaka, Japan

[21] Appl. No.: 964,065

[22] Filed: Oct. 21, 1992

[30] Foreign Application Priority Data

Jul. 24, 1992 [JP] Japan ..... 4-218329

[51] Int. Cl.[6] ..... D01H 13/28; D01H 13/04

[52] U.S. Cl. ..... 57/290; 57/284

[58] Field of Search ..... 57/284, 290, 279, 280, 57/352, 354

[56] References Cited

U.S. PATENT DOCUMENTS

| | | | |
|---|---|---|---|
| 2,081,416 | 5/1937 | Vicq | 57/254 |
| 2,660,856 | 12/1953 | Kingsbury | 57/356 |
| 3,094,835 | 6/1963 | Nimtz et al. | 57/354 |
| 3,506,804 | 4/1970 | Schippers et al. | 28/240 X |
| 3,559,965 | 2/1971 | Ishida | 219/388 X |
| 3,722,462 | 3/1973 | Pohler et al. | 219/388 X |
| 3,842,578 | 10/1974 | Schippers | 57/280 |
| 3,949,544 | 4/1976 | Kitazawa et al. | 57/284 |
| 3,991,545 | 11/1976 | Ritter et al. | 57/290 X |
| 4,236,323 | 12/1980 | Dammann et al. | 57/284 X |
| 4,295,033 | 10/1981 | Lindgren et al. | 219/388 |
| 4,398,386 | 8/1983 | Endo et al. | 57/290 X |
| 4,534,164 | 8/1985 | Toshimasa et al. | 47/282 X |
| 4,567,721 | 2/1986 | Kuroda et al. | 57/284 |
| 4,685,285 | 8/1987 | Leonard | 57/354 X |
| 4,918,914 | 4/1990 | Eaton | 57/284 X |
| 5,138,829 | 8/1992 | Tanae et al. | 57/290 X |
| 5,148,666 | 9/1992 | Bauer et al. | 57/290 |
| 5,193,334 | 3/1993 | Dammann | 57/284 |

FOREIGN PATENT DOCUMENTS

| | | | |
|---|---|---|---|
| 332227 | 9/1989 | European Pat. Off. | 57/284 |
| 412429 | 2/1991 | European Pat. Off. | 57/290 |
| 38-24759 | 4/1958 | Japan . | |
| 54-131059 | 10/1979 | Japan . | |
| 55-16936 | 2/1980 | Japan . | |
| 57-66145 | 4/1982 | Japan . | |
| 61-42937 | 12/1986 | Japan . | |
| 2-60769 | 12/1990 | Japan . | |
| 850080 | 9/1960 | United Kingdom . | |

*Primary Examiner*—Daniel P. Stodola
*Assistant Examiner*—William Stryjewski
*Attorney, Agent, or Firm*—Rothwell, Figg, Ernst & Kurz

[57] ABSTRACT

A heater body has a total length between 0.8 and 1.2 m, the heater body and heating member are divided into two pieces from upstream side to downstream side of the heat treating apparatus in ratio of length between 1:3 and 1:1.5, the divided upstream heating member (12) is able to heat the upstream heater body (11) at a temperature higher than 370° C., and the downstream heating member (22) is to heat the downstream heater body (21) at a temperature of between 200° and 320° C. or higher than 370° C., the upstream heater body has yarn guides (15) disposed at a longitudinal pitch of at most 30 mm, and the downstream heater body has yarn guides (24) disposed at a longitudinal pitch between 80 and 120 mm.

13 Claims, 3 Drawing Sheets

APPARATUS FOR HEAT TREATING A SYNTHETIC YARN DURING FALSE-TWIST TEXTURING

BACKGROUND OF THE INVENTION

The present invention relates to an apparatus for heat treating a synthetic yarn, such as polyester or polyamide, and especially relates to an apparatus for heat treating a synthetic yarn which apparatus is installed in a textile machine for false-twisting or for drawing and false-twisting the synthetic yarn at a high speed of at least 400 m/min. The present invention relates to a heat treating apparatus which is suitable for a so called first heater for heat setting twists which are imparted to a synthetic yarn by a false-twisting device disposed downstream of the heat treating apparatus and which run back along the synthetic yarn.

DESCRIPTION OF RELEVANT ART

When a synthetic yarn is subjected to a false-twisting treatment or a drawing and false-twisting treatment, twists are imparted to the synthetic yarn by a false-twisting device which is disposed downstream of the heat treating apparatus, and the twists run back along the synthetic yarn and are heat set by the first heater.

A known first heater which has been used is of a type in which a running yarn is directly in contact with the heater.

This type of heater has a heating plate of a contact type which is provided with yarn guide grooves and which is curved. The length of the heater varies in accordance with the texturing speed. The lengths of heaters which are generally on the market are about 1 m for a texturing speed of about 100 m/min, 1.5 m for 400 m/min and 2.5 m for 700 m/min. The basic concepts for designing these heaters are that the temperature of the heater is set at the most at 250° C. and the time for heat setting the yarn is set at the least at 0.17 second.

In the meantime, in order to enhance productivity, there is a desire to increase the false-twisting texturing speed. In order to perform such high speed false-twist texturing, the heater length is increased in accordance with the texturing speed or the heater temperature is raised so as to obviate the decrease of the heat set property in the textured yarn.

As a result, the texturing apparatus become huge and, accordingly, the yarn passage are bent. Thus, the run back of the twists and the heat treatment and cooling of the yarn become insufficient. Consequently, it becomes difficult to maintain the quality of the conventional textured yarn. In addition, in the case of a contact type heater, contact resistance on the yarn increases as the heater length increases, and fluffs occur easily. Thus, it becomes difficult to texture yarns of fine denier or to texture at yarns a high speed.

Further, when the yarn is twisted and rotated at a high speed while it is subjected to a false-twist texturing, it may deviate from the yarn guide groove if the heating zone is excessively long. If the yarn speed is increased, ballooning is caused in the twisted yarn which leads to an increase in the number of yarn breakages. Accordingly, stable texturing operation cannot be expected. Since a surging phenomenon, i.e., the phenomenon wherein extreme variation in tension in yarn running in the heating zone, is observed even at a relatively low speed, it is difficult to stably false twist a yarn at a high speed.

In order to overcome these problems and to maintain the stability of texturing operation at high speed, it has been proposed to lower the number of twists and to raise the texturing tension, especially, tension ($T_1$) at upstream of a false twisting device. However, is apparent to a person skilled in the art, good textured yarn qualities cannot be obtained by such an operation.

Contrary to this, when the heater temperature is enhanced to a high temperature, the inclination of the temperature increasing curve of the yarn becomes steep, i.e., the yarn is heated to a high temperature in a very short time. Accordingly, difference in temperatures can be generated at the outer layer and the inner layer of the yarn. Thus, it is difficult to obviate dyeing specks, i.e., those in the same texturing station and those between the separate stations.

Another known first heater is a heater of a non-contacting type which either does not contact or scarcely contacts a running yarn.

For example, Japanese Patent Publication Sho 38-24759 discloses a heat treating device which is disposed upstream of a false twisting device and is provided with a first zone having a 4 inch length (10 cm) and heated at 680° C. by means of electric resistance, and a second zone having a 14 inch length (35 cm) and heated at 250° C. While a yarn of polyamide is introduced into the heat treating device by yarn guides, which are disposed outside of the entrance and the exit of the heat treating device, twists are imparted to the yarn by the false twisting device. Thus, the twists run back along the yarn and are heat set by means of the heat treating device, and the textured yarn is wound in a yarn package at a speed of 370 ft/min (111 m/min).

However, the heat treating apparatus disclosed in Japanese Publication Sho 38-24759 has a problem in that the twists imparted to the yarn cannot be sufficiently set as the texturing speed increases. The reason is that a sufficient amount of heat cannot be transferred to the yarn to be textured while it is moving through the heat treating apparatus at a high speed due to the short length of the heat treating apparatus disclosed in Japanese Publication Sho 38-24759. Accordingly, the heat treating apparatus disclosed in Japanese Publication Sho 38-24759 cannot be used at a texturing speed equal to or higher than 400 m/min.

In order to overcome this problem, it has been proposed to increase the length of the heat treating apparatus disclosed in Japanese Publication Sho 38-24759. However, if the length of the heat treating apparatus is increased, yarn breakages occur frequently and the yarn cannot be sufficiently textured. Thus, there is a problem that the heating apparatus cannot be used practically used.

In order to meet with the recent requirement to enhance the productivity of a false twisting machine or a drawing and false twisting machine, it has been proposed to enhance the temperature of a heat treating apparatus for heating setting false twists imparted to a synthetic yarn to at least 300° C. (see Japanese Patent Application Laid-open No. Sho 55-16936).

In this arrangement, a heat treating apparatus of a non-contacting type, wherein the yarn is not directly in contact with the heating member but is passed through a yarn path surrounded by a heating wall, is used for the heat setting of false twists during a false twisting procedure or a drawing and false twisting procedure since the resistance to the imparted false twists is small in such a non-contacting type heat treating apparatus.

However, in such a non-contacting type heat treating apparatus there are problems in that twists are not fully run back along the yarn since the yarn creates vibration or ballooning in the heat treating apparatus, heat is not transferred well to the yarn since the yarn becomes unstable due to the vibration and, accordingly, the yarn quality is deteriorated.

The above-described problems become increasingly significant as the yarn treating speed increases, and such problems are the main reason why high speed treatment is difficult.

Japanese Publication No. Hei 2-60769 discloses that a non-contacting type heater is used as the first heater upon false-twist texturing of polyester fiber comprising polyethylene terephthalate. The temperature of the heater is set between 350° C. and 800° C., and the false-twist texturing takes place while the heat treating time is set between 0.04 and 0.12 second. During this texturing operation, yarn passage limiting guides are disposed so that the yarn passes along an arc to prevent the occurrence of ballooning.

When a false twisted yarn is heat treated at a high temperature, the heater temperature is usually set so that the yarn at the exit of the heater is heated at a temperature which is required for the yarn. More specifically, for polyester yarn, the set heater temperature is such that the temperature of the yarn at the exit of the heater is between 190° and 230° C., for example 220° C. The specific set heater temperature is determined taking into consideration the yarn speed, the thickness of the yarn, i.e., denier, the length of the heater, etc.

In the case of polyester, for example, it has been observed that quality of the obtained yarn becomes deteriorated, i.e., poor in the crimp characteristics, if the treatment time at high temperature is less than 0.35 second. The reason for this deterioration is a large difference in temperatures at the surface portion and the central portion of the yarn caused by high temperature heat treatment for a short time. Thus, upon heat treatment, it cannot be said without careful consideration that the heater length may be shortened and the treatment performed at such a high temperature that the temperature at the exit can be achieved.

Further, in general, heaters which have been used in a false-twisting machine or a drawing and false-twisting machine have a constant length which is determined in accordance with the machine specification. In such a conventional machine, since the heater length is constant, the range wherein the texturing conditions can be varied is narrow.

However, when the temperature of the heater is set at a temperature higher than the melting point of a yarn upon polyester or polyamide yarn, the yarn may remain within the heater if the yarn is broken during the yarn treatment. The remaining yarn may be melted and may adhere to the yarn path limiting guides which are disposed within the heater. The melted and adhered material is referred to as "adhesive" hereinbelow in the present specification. Although the adhesive can be easily removed if an appropriate cleaning article is used, it is a very troublesome operation to manually remove the adhesive from a heater which is heated at a high temperature depending on the locations where the yarn path limiting guides are disposed.

In this situation, it is necessary to lower the set heater temperature below 400° C. depending on the texturing conditions. For example, the method disclosed in Japanese Publication No. Hei 2-60769 is advantageous for obtaining a textured yarn having a high percentage crimp, i.e., a yarn with a high percentage crimp TC of between 25 and 35%. Contrary to this, the method is disadvantageous for obtaining a textured yarn having a low percentage crimp, i.e., a yarn with a low percentage crimp TC of between 15 and 25%. The textured yarn with a low percentage crimp is obtained by heat treating a yarn at a temperature lower than 350° C.

When the temperature of the heater is set at a temperature higher than the melting point of a yarn but lower than 400° C., the yarn may remain within the heater if the yarn is broken due to entangled fluffs during the yarn treatment and, as described above, a problem arises in that re-threading operation cannot be done for a long time upon breakage. Depending on the set heater temperature, it takes a lot of time until the adhesive is vaporized, in other words, until it changes from its liquidized state. Further, if a yarn is threaded again before the adhesive has been vaporized, i.e., the material is in a liquid state which is at a high temperature and which has a large heat capacity, the adhesive adheres to the traveling yarn. Thus, the re-threaded yarn is melted and is broken. Accordingly, it is impossible to thread again while adhesive in a liquid state is observed on the yarn path limiting guides.

In view of the above-described various problems, one of the present applicants previously proposed a heat treating apparatus which overcome the disadvantage that the threading operation cannot be done for a long time after yarn breakage, which cleans itself, can be threaded in a short time after yarn breakage without the necessity of manual cleaning, and by which wide treating conditions can be realized (Japanese Patent Application Laid-open No. Hei 3-234834).

More specifically, the applicant proposed an apparatus for heat treating a synthetic yarn which comprises: a heater body for completely or partially encircling the synthetic yarn, which is being false twisted or being drawn and false twisted, in a non-contacting condition therewith; a heating member disposed in the heater body for heating the heating wall thereof at a high temperature; and yarn guides disposed in a yarn passage surrounded by the heating wall of the heater body, characterized in that the heater body and the heating member are longitudinally divided into at least two pieces.

According to the knowledge of the applicant regarding the proposal, when, for example, a polyester filament yarn was treated, the time which was needed before removal of adhesive depended on the temperatures of the heater as set forth below. When the temperature of the heater was 370° C., it took about 60 minutes; 450° C., about 2 minutes; and 500° C., about 10 seconds.

Consequently, it has been observed that when the temperature of the heater is set higher than 400° C., the yarn adhered to the yarn path limiting guides can be vaporized in a short time and that thus a heater having a self cleaning characteristic can be obtained.

In the apparatus disclosed in Japanese Patent Application Laid-open No. Hei 3-234834, the heater body has a total length of 1 m and is divided in its lengthwise direction into two portions, i.e., the upstream heater 0.7 m long and the downstream heater 0.3 m long, and sheath heaters for heating the divided heater bodies are installed in the heater bodies. Both sheath heaters may be heated simultaneously, or one of the sheath heaters may be mainly heated. Further, the heating conditions of both the sheath heaters may be different. The heater bodies have yarn guides equidistantly disposed in a yarn running direction. The yarn guide has a recessed portion at a position corresponding to the yarn running portion. The imaginary line connecting the bottoms of the recesses, where the yarn Y travels, forms a slight arc so that ballooning of the yarn Y is prevented.

As described above, in the apparatus disclosed in Japanese Patent Application Laid-open No. Hei 3-234834, the set heater temperature is basically set so that the temperature of the yarn at the exit of the heater reaches a temperature between 190° and 230° C., for example 220° C. The specific set heater temperature is determined taking into consideration the yarn speed, the thickness of the yarn, i.e., denier, the length of the heater, etc.

When a thick yarn, i.e., a yarn having a large denier, is heat treated, both the divided heaters are set at a same high temperature. Contrary to this, when a thin yarn, i.e., a yarn having a small denier, is heat treated, either one of the divided heaters is mainly heated and its temperature is enhanced. For example, if the temperature of the yarn guides disposed in the downstream heater is more than 400° C. and if the time needed for the yarn to pass through the downstream heater is more than 0.035 second, the upstream heater is not heated.

Contrary to this, if the time needed for the yarn to pass through the downstream heater is less than 0.035 second while the temperature of the yarn guides disposed in the downstream heater is more than 400° C., the temperature of the upstream heater is set so that the yarn guides disposed in the upstream heater reach a temperature lower than 250° C., at which the yarn does not adhere to the yarn guide and accordingly, the total time which is required by the yarn to pass through the entire heaters is increased.

When heat treatment is performed at a temperature higher than 400° C., or more preferably higher than 450° C., in the false twisting or draw false twisting treatment of a polyester yarn in accordance with the proposed apparatus, if the yarn adhere to the yarn guides upon breakage of the yarn, the adhesive is vaporized in a short time. Thus, the surfaces of the yarn guides recover their original conditions and, accordingly, threading operation can be readily carried out.

There are various kinds of yarns to be heat treated in false twisting machines or draw texturing machines, and the acceptable range of treating speeds in very wide depending on the required yarn quality. Under such conditions, the heat treating apparatus of the proposed apparatus can realize a heater provided with self cleaning capability under wide conditions.

However, when a POY yarn, i.e., a partially oriented yarn, of synthetic fiber, such as polyester or polyamide, is drawn and false-twisted by means of the proposed apparatus, problems such as decreased strength of the obtained textured yarn may occur. Further dyeing speck and/or irregularity in dyeing may be observed around the knotting portion if yarn ends of the supply packages are connected by means of an air splicer.

OBJECTS OF THE INVENTION

It is an object of the present invention to provide an apparatus for heat treating a synthetic yarn during false-twist texturing and a method for false-twist texturing by which the problems inherent to the apparatus disclosed in Japanese Patent Application Laid-open No. Hei 3-234834, can be obviated.

It is another object of the present invention to provide an apparatus for heat treating a synthetic yarn during false-twist texturing which can clean itself and can be threaded in a short time after yarn breakage without the necessity of manual cleaning.

It is a further object of the present invention to provide an apparatus for heat treating a synthetic yarn during false-twist texturing and a method for false-twist texturing by which a wide range of treating conditions can be realized.

SUMMARY OF THE INVENTION

According to an aspect of the present invention, the above-described objects are achieved by an apparatus for heat treating a synthetic yarn which comprises:

a heater body for completely or partially encircling in a non-contacting condition with the synthetic yarn, along which twists, imparted by a false twisting device disposed downstream of said heater body, run back along the yarn;

a heating member disposed in said heater body for heating a heating wall of said heater body at a high temperature;

yarn guides disposed in a yarn passage surrounded by said heating wall of said heater body;

a total length of said heater body being between 0.7 and 1.3 m;

said heater body and said heating member being respectively divided into two pieces from said upstream side to said downstream side of said heat treating apparatus in a ratio of length between 1:3 and 1:1.5;

said upstream heating member of said divided heating member being able to heat said upstream heater body at a temperature higher than 370° C., and said downstream heating member being able to heat said downstream heater body at a temperature of between 200° and 320° C., or to 0° temperature higher than 370° C.;

said upstream heater body having said yarn guides disposed at a longitudinal pitch of at most 30 nm; and said downstream heater body having said yarn guides disposed at a longitudinal pitch between 80 and 120 mm.

Further, according to the another aspect of the present invention, the above-described objects are achieved by a method for high speed false-twist texturing a yarn simultaneously with drawing said yarn in an apparatus comprising a false twisting device, and a heater body disposed downstream of a heater body and for completely or partially encircling the synthetic yarn, along which twists, imparted by said false twising device, run back along the yarn, and wherein said heater body is of a non-contacting type and is divided into two pieces from said upstream side to said downstream side in a yarn running direction. The length of said upstream heater body is between 0.2 and 0.5 m and the length of said downstream heater body is between 0.5 and 0.8 m, a temperature of said upstream heater body is set at least 400° C. and less than 800° C., and said yarn is treated at said upstream heater body for at least 0.01 second and less than 0.04 second, and a temperature of said downstream heater body is set at most 320° C., and said yarn is treated at said downstream heater body for at least 0.03 second and less than 0.08 second.

After proposal of the apparatus disclosed in Japanese Patent Application Laid-open No. Hei 3-234834, the present inventors have conducted further investigation and have found the following.

As described above, the temperature of the heater has to be set higher than 400° C., in order to self clean in a short time the yarn path limiting guides to which a yarn has adhered. However, in actual operation, an operator takes necessary steps when he finds a station wherein a yarn breakage has occurred and then he performs a re-threading operation at once if it is available. Contrary to this, if he finds it difficult to re-thread at once, then he preceeds to take the necessary steps on the next station since a plurality of spindles are installed in a false-twisting machine or a drawing and false-twisting machine. He performs a re-threading operation later on the station wherein a yarn breakage has not been proceeded. Accordingly, it has been found that if the temperature of the yarn guide is higher than 370° C., and more preferably higher than 390° C., the adhesive on the yarn guide changes in a relatively short time into a condition which is suitable to a re-threading operation, and thus there occurs no practical problem.

Further, if the temperature of the yarn guide is equal to or less than 340° C., and more preferably equal to or less than 320° C., the heat capacity of the adhesive is small and the yarn will not be broken easily upon the re-threading operation. The adhesive may be brought by the re-threaded yarn, and accordingly, practically, there occurs no problem of yarn breakage of the re-threaded yarn.

In addition, if the temperature of the yarn guide is at most 320° C., since probability of adhesion of the yarn is very small upon breakage, the re-threading operation can be done in a few minutes and can be done well.

The present invention has been achieved based on the above-described new technical knowledge.

According to the present invention, the heater body and the heating member are divided into two pieces and, the upstream side of the heating apparatus is shorter than the downstream side of the heating apparatus. Both the upstream and downstream heater bodies may be simultaneously heated so that the upstream heater body is heated to a high temperature higher than 370° C., and the downstream heater body is heated to a low temperature between 200° C., and 320° C., more preferably, between 250° C. and 320° C., or to a high temperature higher than 370° C., or only the downstream heater body is heated to a low temperature between 250° C. and 320° C. or to a high temperature higher than 370° C. The upstream heater body which will be heated to a high temperature higher than 370° C. has yarn guides disposed at a longitudinal pitch of at most 30 mm, and the downstream heater body has yarn guides disposed at a longitudinal pitch of between 80 and 120 mm.

The yarn is quickly heated by means of the upstream heater body which is heated to a high temperature, and the temperature of the yarn is adjusted to a desired exit temperature by means of the downstream heater body which is heated to a low temperature. In order to achieve this purpose, according to the present invention, the upstream heater body is heated to a high temperature. If the length of the high temperature heater is too long, a yarn may be subjected to a heat treatment under conditions which exceeds the strength and elongation limit of the yarn, and thus, there may be a problem of decreased strength of the obtained textured yarn. Contrary to this, according to the present invention, the upstream heater body which will be heated to a high temperature is shortened, and the above-described problem of the decrease in the strength of the obtained textured yarn can be obviated.

Ballooning of the yarn in the upstream heater body is prevented from occurrence by means of yarn guides, which are disposed closer than conventional guides, and thus prevented is the fluctuation in heat transfer to the yarn from the upstream heater body, which is heated to a high temperature. As a result a good textured yarn which is free from dyeing speck can be obtained.

In contrast to this, in the apparatus disclosed in the above-described Japanese Patent Application Laid-open No. Hei 3-234834 the pitches of the yarn guides in the upstream and downstream heater bodies are the same and are about 100 mm, which is common in a conventional machine. Accordingly, ballooning is caused in the running yarn in both the upstream and downstream heater bodies, the degrees of the ballooning being almost the same in both the upstream and downstream heater bodies. Thus, the fluctuation is caused in heat transfer to the yarn from the upstream heater body, which is heated to a high temperature, and as a result the obtained textured yarn has dyeing speck.

Further, in the heating apparatus disclosed in the above-described Japanese Patent Application Laid-open No. Hei 3-234834, causes fluctuation in heat transfer to the yarn from the upstream heater body, which is heated to a high temperature. Accordingly, when a knot portion, which has been subjected to a knotting operation and to mechanical damage by means of an air splicer, passes through the high temperature heater irregularity in dyeing is caused. Contrary to this, according to the present invention, ballooning of the yarn is prevented from occurring in the upstream heater body by means of yarn guides which are disposed closely and, thus, fluctuation in heat transfer to the yarn from the upstream heater body and irregularity in dyeing is prevented from occurring.

In addition, according to the present invention, in comparison with the heating apparatus disclosed in the above-described Japanese Patent Application Laid-open No. Hei 3-234834, the divided ratio between the upstream and downstream heater bodies and the heating members is reversed. Accordingly, the above-described dyeing speck and irregularity in dyeing can be easily prevented and a wide range of texturing conditions can be obtained.

BRIEF DESCRIPTION OF THE DRAWINGS

The present invention will now be explained in detail with reference to the attached drawings for illustrating some embodiments of the present invention, wherein.

PREFERRED EMBODIMENTS

Figure 3:
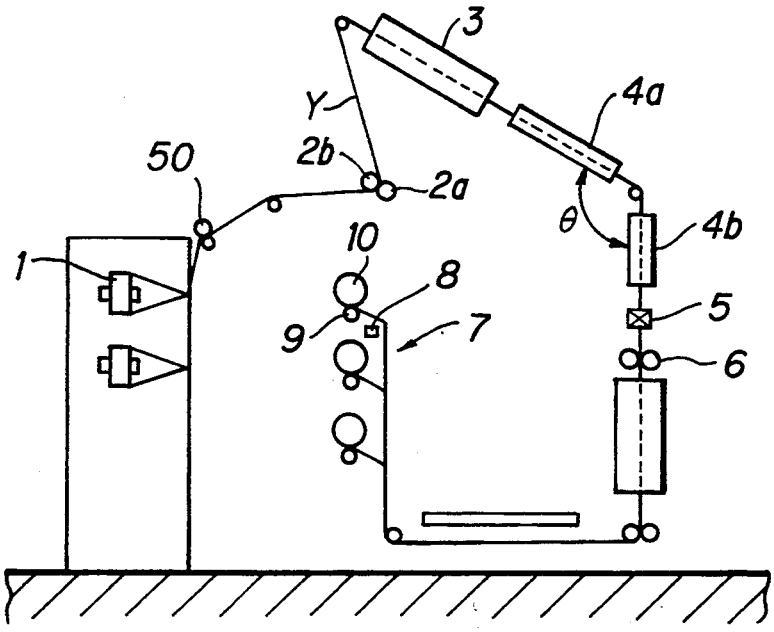
FIG. 3 is a schematic view of a drawing and false-twist texturing machine provided with a heating apparatus according to the present invention.

In FIG. 3 illustrating a schematic view of a drawing and false-twist texturing machine provided with a heating apparatus according to the present invention, a yarn Y is withdrawn from a yarn supply 1 by means of withdrawal rollers 50. The withdrawn yarn Y is drawn at a predetermined draw ratio between first feed rollers 2, which comprise a pair of rollers 2a and 2b, and second feed rollers 6, and at the same time twists are imparted to the yarn Y by means of a conventionally known twisting device 5, such as friction belts, friction discs or a false twisting spindle. Instead of false twisting operation carried out simultaneously with the drawing operation, false twisting operation may be performed after the drawing operation.

Twists, which have been imparted to the yarn Y by means of the twisting device 5, run back toward the first feed rollers 2 along the yarn Y. The twists running back along the yarn Y are heat set by a heat treating apparatus 3, and then the yarn Y is cooled in a stabilizing track 4 disposed below the heat treating apparatus 3.

As described above, between the first feed rollers 2 and the second feed rollers 6, twists are imparted to the yarn Y located upstream relative the twisting device 5 and the yarn Y is de-twisted after it passes through the twisting device 5. Then the yarn Y is fed to a take up device 7 from the second feed rollers 6.

The take up device 7 comprises a traverse device 8, which traverses the yarn Y to and fro, a bobbin holder 10, onto which a bobbin for winding the yarn Y is inserted, and a friction roller 9, which is pressed to the bobbin or the yarn layer wound on the bobbin so as to rotate the bobbin.

Figure 1:
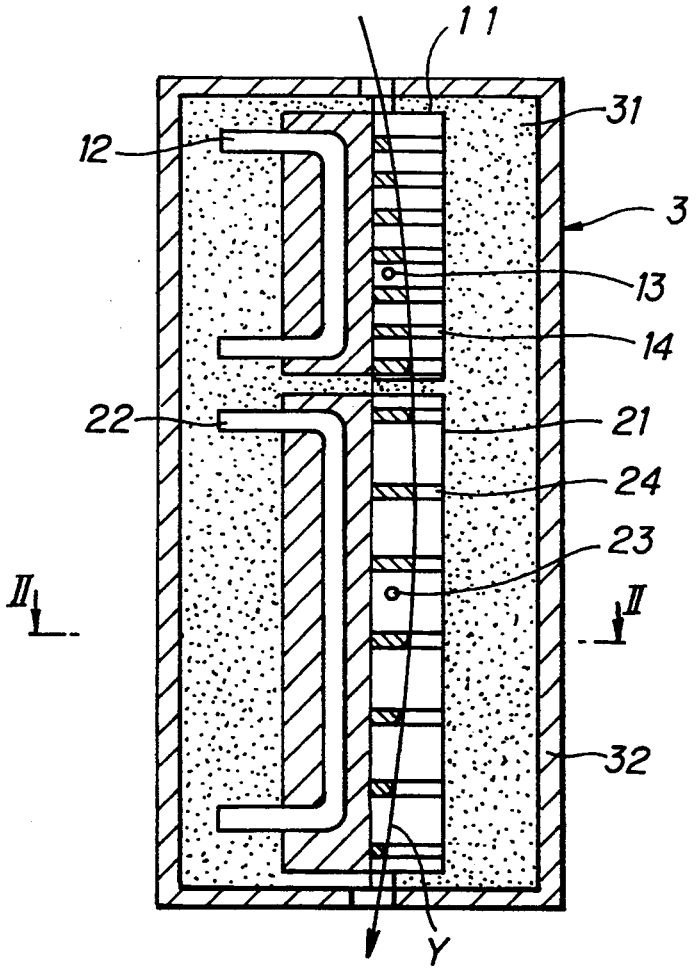
FIG. 1 is a longitudinal sectional view of an embodiment of the present invention.

The construction of the first embodiment of an apparatus for heat treating a synthetic yarn according to the present invention will now be explained in detail with reference to FIGS. 1 and 2.

A heater body has a total length of between 0.7 and 1.3 m, more preferably between 0.8 and 1.2 m. As clearly illustrated in FIG. 1, in the present heat treating apparatus 3, the heater body and a heating member, i.e., sheathed heater in this embodiment, are divided into two pieces, respectively, in the longitudinal direction of the heat treating apparatus 3 in a ratio of between 1:3 and 1:1.5. When the yarn speed is higher than 1000 m/min, it is preferred that the length of the upstream heater body be between 0.2 and 0.5 m, and that the length of the downstream heater body be between 0.5 and 0.8 m.

The heating member is not limited to the above-described sheathed heater and may be any conventionally known heater, such as a plate heater, other than the sheathed heater.

More specifically, the heater body is divided into two pieces, i.e., upstream and downstream heater bodies 11 and 21, in a longitudinal direction thereof, and the sheathed heaters 12 and 22 are mounted in the upstream and downstream heater bodies 11 and 21, respectively, in order to heat the upstream and downstream heater bodies 11 and 21. Reference numerals 13 and 23 denote a sensor for detecting a temperature.

The divided upstream heating member, i.e., the sheath heater 12 can be heated to a temperature exceeding 370° C. and the downstream heating member, i.e., the sheath heater 22 can be heated to a temperature of between 200° and 320° C., and more preferably, between 250° and 320° C., or to a temperature exceeding 370° C. Both the sheath heaters 12 and 22 may be heated simultaneously, or only the sheath heater 12 or 22 may be heated. It is preferred that the temperature of the heating member is less than 800° C., since the durability of a heating member is deteriorated if it is heated over 800° C., since energy consumption increases remarkably and desired heat set effect cannot be achieved because of shortness of heat set time. The setting of the heating conditions is done by means of a controller (not shown).

The outer surfaces of the upstream and downstream heater bodies 11 and 21 are surrounded by a common heat insulator 31 which is in turn coated by a common insulator cover 32.

Figure 2:
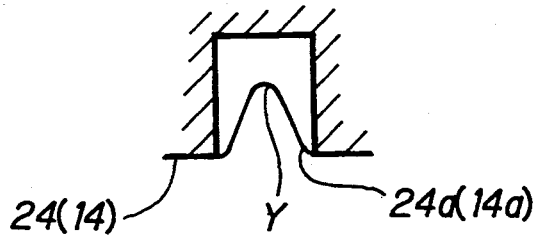
FIG. 2 is a sectional view taken along line II—II in FIG. 1.

As illustrated in FIG. 2, a plurality of yarn guides 14 and 24 are spaced in a yarn traveling direction in this embodiment. The upstream heater body 11 has yarn guides 14 at a small pitch of at most 30 mm, preferably between 10 and 30 mm, and preferably between 15 and 30 mm, in a lengthwise direction thereof. The downstream heater body 21 has yarn guides 24 at a large pitch of between 80 mm and 120 mm in a lengthwise direction thereof.

The yarn guides 14 and 24 have recesses 14a and 24a formed at positions corresponding to the yarn path as illustrated in FIG. 2. It is preferred for the yarn to be prevented from vibrating, i.e., ballooning, by forming the recesses 14a, 24a such that an imaginary line connecting the bottoms thereof, where the yarn Y travels, follows a slight arc. Further, it is preferred that the material of the heater bodies 11 and 24 and the yarn guide 14 and 24 has good thermal conductivity and has ceramic coating on the surface thereof.

The time for heat treatment differs depending on the yarn speed, denier of the yarn and so on. However, it is preferred that the heat treating time in the upstream heater body is equal to or more than 0.01 second and equal to or less than 0.04 second for a yarn speed higher than 1000 m/min when the temperature of the downstream heater body is less than 320° C. In this case, if the heat set time is less than 0.01 second, the obtained textured yarn is insufficient in its percentage crimp and its strength. If the time exceeds 0.04 second for a yarn of 150 denier, dyeing becomes light, and dyeing speck occurs frequently and becomes remarkable. Therefore, a heat set time exceeding 0.04 second is not preferable. Contrary to this, it is preferred for the downstream heater body that the heat treating time is set equal to or longer than 0.03 second but equal to or less than 0.08 second. If the heat set time is less than 0.03 second, the obtained textured yarn may have decreased strength, surging may occur easily, and dyeing speck may also occur easily. The region exceeding 0.08 second is not desirable since fluffs generated during texturing operation may be observed in a yarn with relatively small denier, and accordingly, its quality may be deteriorated.

When the yarn speed is increased to over 1000 m/min, it is desirable that the thickness of the textured yarn is set between 20 and 150 denier. If the thickness of the textured yarn exceeds 150 denier, the texturing speed should be reduced so as to obtain the textured yarn with desired strength and crimp characteristics. Contrary to this, if the texturing speed for a yarn is set higher than 1000 m/min to obtain the textured yarn with thickness less than 20 denier, the yarn is subjected to a large load upon withdrawal from the creel. Accordingly, tight spots may be created by a small tension variation and dyeing speck may be created easily as well.

As described above, the temperature of the heat treating apparatus 3 is basically set so that the yarn temperature at the exit of the heat treating apparatus 3 is between 190° and 230° C., for example, 220° C., in case of polyester yarn. The yarn temperature depends on the heater length, the yarn speed, yarn thickness, i.e., denier, and the set heater temperature. For example, cases for polyester yarns of 150, 100, 75 and 50 denier, which denier is measured in the obtained textured yarns, will now be explained.

In the preferred embodiment, the upstream heater body 11 has a length of 0.26 m, the downstream heater body 21 has a length of 0.64 m, and total length of the heater is 0.90 m.

(1) In the case of a yarn of 150 denier

Figure 4:
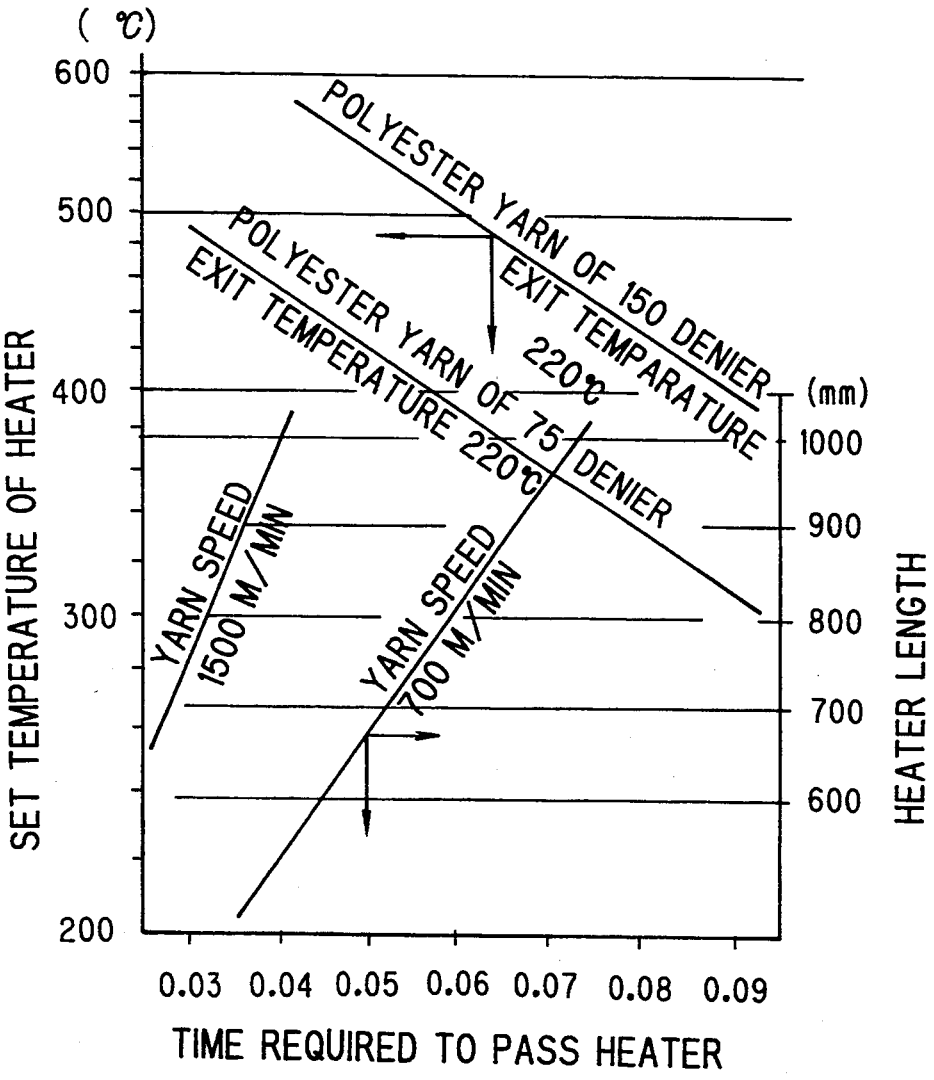
FIG. 4 is a diagram illustrating the relationship between the set temperatures of a heater and the temperatures of yarns measured at the exit of the heater.

When both the divided heater bodies 11 and 21 are simultaneously heated, times needed for a yarn to pass through the heater having a total length of 0.90 mm are read for the yarn speeds of between 800 and 1500 m/min from the lower part of FIG. 4, and then the heater temperatures, which are required by the yarn of 150 denier to be heated to 220° C. at the exit of the heater after being heated for the times obtained above, are read from the upper part of FIG. 4.

In conclusion, in order to ensure the yarn temperature at the exit of the heater to be 220° C., the temperatures of the heater are required to be set between 456° and 582° C. for a yarn having 150 denier and traveling between 800 and 1500 m/min.

Thus, when the upstream and downstream heater bodies are simultaneously heated over 370° C., if the yarn is adhered to the yarn guide or yarn guides upon its breakage, the adhesive disappears in a short time since the temperature of the yarn guides is high, i.e., higher than 400° C., and the yarn guides are cleaned by themselves. Accordingly, it is possible for an operator to thread again after a short stoppage. As described above, if the temperature of the yarn guides exceeds 370° C., more preferably 390° C., the adhesive on the yarn guides disappear in a relatively short time, and re-threading operation can be performed. Therefore, the temperature of the downstream heater may be set at a temperature lower than 400° C. but higher than 370° C.

(2) In the case of a yarn of 75 denier

When the heater length is 0.90 m, i.e., both the divided heater bodies are simultaneously heated, as is apparent from FIG. 4. The heater temperatures are require to be set between 355° and 455° C. for a yarn having 75 denier and traveling between 800 and 1500 m/min so that the yarn temperature at the exit of the heater is 220° C. In short, the temperature of the yarn guides, i.e., the set temperature of the heater, becomes lower than 400° C. for the yarn speed less than about 1050 m/min, and the yarn, which has once adhered to the yarn guides, remains on the yarn guides for a long time in a melted state. Accordingly, even if the threading operation is tried again, the threading success ratio becomes very low. In other words, the operator can scarcely succeed in such a threading operation.

In order to increase the threading success ratio, when the upstream heater having a length of 0.26 m is heated to a temperature higher than 400° C. among the two heaters, i.e., the heaters of 0.26 m and 0.64 m in the embodiment, while the remaining heater having a length of 0.64 m is heated to a temperature of between 250° and 320° C., the temperature required for the upstream heater is between 410° and 500° C. for the above-described yarn speed range. Accordingly, the heater has a self cleaning capability. Accordingly, the threading success ratio becomes very high. In other words, the operator can always succeed in such a threading operation.

(3) Further, when a thin yarn is heat treated, the following uses are possible since the heater body and the heating member are divided into two portions.

While the upstream heater having a length of 0.26 m is kept at a temperature equal to or higher than 400° C., the temperature of the downstream heater is set at a relatively low temperature. In some cases, the upstream heater may be switched off, and the downstream heater of 0.64 m long is heated to a temperature exceeding 370° C. Thus, the temperature of the yarn at the exit of the heater is maintained at a predetermined temperature of between 190° and 230° C., for example, 220° C.

An example of the above-described conditions is shown in Table 1.

TABLE 1

| Textured Yarn Denier De | Suply POY Yarn Denier De/F | Yarn Texturing Speed m/min | Temperature of Upstream Heater 0.26 m long °C. | Temperature of Downstream Heater 0.64 m long °C. |
|---|---|---|---|---|
| 30 | 45/18 | 750 | 450 | 220 |
| 50 | 70/40 | 800 | 450 | 260 |
| 50 | 75/36 | 850 | 450 | 280 |
| 75 | 125/36 | 1000 | 550 | 280 |
| 75 | 125/72 | 700 | 500 | 260 |
| 100 | 160/36 | 800 | 550 | 320 |
| 150 | 250/32 | 900 | 550 | 440 |

In these cases, none of the temperature of the upstream and downstream heaters is set in a range between 340° and 370° C. More preferably, none of the upstream and downstream heater temperatures are set in a range between 320° and 390° C. When the temperature is higher than this range, should the yarn be broken, the adhesive caused by the broken yarn will disappear in a short time even if the temperature is less than 400° C., and the re-threading operation can be performed, and if the temperature is equal to or higher than 400° C., the adhesive will be vaporized in a very short time as described above and yarn breakage upon the re-threading operation does not occur. When the temperature is lower than this range, the heat capacity of the adhesive is small and the yarn will not be broken easily upon the re-threading operation. The adhesive may be brought by the re-threaded yarn, and accordingly, practically, there occurs no problem of yarn breakage of the re-threaded yarn.

According to the present invention, the heater body and the heating member are divided into two portions in a ratio of between 1:3 and 1:1.5. The upstream heating member can heat the upstream heater body at a temperature higher than 370° C., and the downstream heating member can heat the downstream heater body at a temperature of between 250° and 320° C. or higher than 370° C. Further, according to the present invention, the upstream heater body has yarn guides disposed at a small longitudinal pitch of at most 30 mm, preferably between 10 and 30 mm, and more preferably between 15 and 30 mm for ensuring a slight arc yarn passage. Due to this construction, as shown in Table 2, the irregularity in dyeing around the knotted portion can be reduced, and a yarn with a good quality free from dyeing speck can be obtained. The yarn guide pitch in comparison was 100 mm.

TABLE 2

| | Comparison | Embodiments |
|---|---|---|
| Heater Length (mm) | 900 | Upstream 260<br>Downstream 640 |

TABLE 2-continued

| | Comparison | Embodiments | | |
|---|---|---|---|---|
| Heater Temperature | Single Heater 360° C. | Upstream<br>Downstream | 450° C.<br>340° C. | 550° C.<br>340° C. |
| Irregularity in Dyeing around Knotted Portion 75 De Texturing Speed 1000 m/min Dyeing Speck Texturing Speed 800 to 1000 m/min | Allowable Limit | | Very Good | Very Good |
| Draw Ratio 1.58 | Good | | Good | Good |
| Draw Ratio 1.66 | Good | | Very Good | Very Good |

Figure 5:
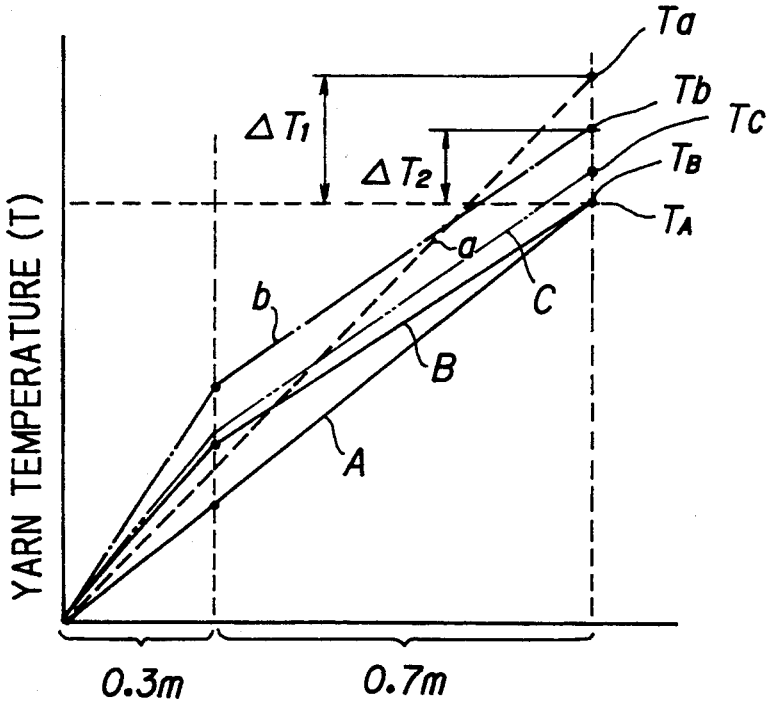
FIG. 5 is a diagram illustrating the temperature increasing status in the heating apparatus.

The reason will be explained with reference to FIG. 5 is a diagram illustrating the temperature increasing status in the heating apparatus. Although the practical yarn is heated along a curve, in order to simplify the explanation and taking into consideration that the treating time is very short, the behaviors are shown by straight lines.

In FIG. 5, A denotes behavior in a condition wherein the upstream heater of 0.3 m long and the downstream heater of 0.7 m long have yarn guides at a pitch of 100 mm and are set at the same temperature, and the heaters as a whole perform heating characteristics similar to those of a conventional beater, which will be referred to as a single heater, having a 1 meter length, and the yarn temperature $T_A$ at the exit of the heater is 220° C.

When a knot portion of the yarn passes through the heater under these conditions, the yarn is vibrated due to the knot portion and the amount of heat transfer is increased due to the vibration. Thus, the yarn temperature in the heater is enhanced as indicated by a broken line a, and the yarn temperature $T_a$ at the exit of the heater is remarkably enhanced compared with the usual yarn temperature $T_A$ at the heater exit, the difference in the temperatures is denoted by $\Delta T_1$, thus irregularity in dyeing is caused around the knot portion.

Reference B denotes the yarn temperature change under a condition wherein the upstream heater body of 0.3 m long is heated to 500° C., and the downstream heater body of 0.7 m is heated to 270° C. The yarn guide pitch was 100 mm for the upstream and downstream heater bodies. The yarn temperature $T_B$ at the exit of the heater is set to the above-described temperature $T_A$.

When a knot portion of the yarn passes through the heater under these conditions, the yarn is vibrated in the upstream heater body due to the knot portion, and the amount of heat transfer is increased due to the vibration. Thus, the yarn temperature in the heater is enhanced as indicated by a dot-and-dash line b. However, since the temperature of the downstream heater is low, the change in the temperatures is small, and the yarn temperature $T_b$ at the exit of the heater is slightly enhanced compared with the usual yarn temperature $T_A$ at the heater exit, the difference in the temperatures is denoted by $\Delta T_2$, i.e., $\Delta T_2$ is smaller than $\Delta T_1$. Thus almost no irregularity in dyeing is caused around the knot portion.

Further, according to the present invention, the upstream heater body has yarn guides at a longitudinal pitch of at most 30 mm, preferably between 10 and 30 mm, more preferably between 15 and 30 mm. As a result of disposition of yarn guides at such a narrow pitch, the yarn temperature changes along a two-dot-and-a-line c in the heater. More specifically, the vibration of the yarn is substantially prevented from occurring in the upstream heater body of 0.3 m length by means of the yarn guides which are disposed closely to each other. Accordingly, the inclination of the heating characteristics is smaller than that of the dot-and-dash line b in the upstream heater body portion of 0.3 m long. When the yarn guide pitch is set at 100 mm in the downstream heater body of 0.7 m long, the inclination of the two-dot-and-a-line c is substantially in parallel with the dot-and-dash line b in the downstream heater body portion of 0.7 m long. As a result, the yarn temperature $T_c$ at the exit of the heater is lower than the yarn temperature $T_b$ and approaches the yarn temperature $T_B$. Thus, irregularity in dyeing is further reduced.

The relationship between the yarn guide pitches and the occurrence of irregularity in dyeing and dyeing speck is shown in Table 3. As it will be readily noted from Table 3, irregularity in dyeing and dyeing speck is increasingly prevented from occurring as the yarn guide pitch is narrowed.

Table 3 shows the evaluation totally taking into consideration the results with respect to the irregularity in dyeing and dyeing speck which were obtained by using a single heater, the temperature of the heater being changed at a pitch of 20° C. in a range between 320° and 480° C.

TABLE 3

| | Pitch of Yarn Guide (mm) | | |
|---|---|---|---|
| | 100 | 30 | 20 |
| Irregularity in Dyeing around Knotted Portion 75 De Texturing Speed 1000 m/min Dyeing Speck Texturing Speed 800 to 1000 m/min | Bad | Allowable Limit | Very Good |
| Draw Ratio 1.58 | Allowable Limit | Allowable Limit | Good |
| Draw Ratio 1.66 | Good | Good | Very Good |

As it will be understood from FIG. 5 and Tables 2 and 3, the gist of the present invention resides not only in dividing of a heater into two pieces or disposition of yarn guides at a narrow pitch, but a combination of these technical features. Further, in the present invention, the length of the upstream heater body of high temperature, where a yarn is easily influenced by the high temperature, is made shorter than that of the downstream heater body, and when the yarn guide pitch in the upstream heater body is made narrow the irregularity in dyeing and dyeing speck are almost completely prevented from occurrence.

Although the yarn guide pitch was equidistant in the above-described embodiments, according to the present invention, the pitches of the yarn guides disposed on the upstream and the downstream heater bodies may be non-equidistant. The yarn guides disposed in this construction can prevent ballooning, the nodes of which coincide with the yarn guides. Thus, occurrence of dyeing speck and irregularity in dyeing around a knot portion can be prevented.

Many kinds of yarns are textured in a false-twisting machine or a drawing and false-twisting machine, and the range of the texturing speeds is wide depending on the required yarn quality. Under these conditions, the heat treating apparatus according to the present invention can be used for a wide range of the texturing conditions and is of a self cleaning type. Further, the heating apparatus can be used in a condition wherein yarn breakage substantially does not occur.

According to the present invention, manual cleaning of the heater can be omitted, and the design of the heater may be free from manual cleaning operations. Therefore, the equipment becomes simple and the cost can be low since it is unnecessary for a designer to take into consideration the easiness of manual cleaning at the positions where the heaters are installed in a false twisting machine or a draw texturing machine.

Further, according to the present invention, the heat treating apparatus can be shortened remarkably. When a yarn is textured at a high speed of about 1000 m/min, the length of the heat treating apparatus can be almost one half of the conventional heater. Thus, the equipment can be compact, and uniform and sufficient heat treatment can be carried out.

In addition, re-threading capability upon yarn breakage is improved, and stable operation is possible. Further, the range wherein percentage crimp TC is adjusted can be widened. Therefore, the heating apparatus is available for wide usage. By shortening the heat treating apparatus, the yarn contacting resistance is reduced, and occurrence of fluffs is decreased. Further, surging phenomenon, which may occur during high speed false-twist texturing, is prevented. Accordingly, a stable false-twist texturing operation can be carried out at high speed.

What is claimed is:

1. An apparatus for heat treating a synthetic yarn which comprises:

a heater body for at least partially encircling a synthetic yarn in a non-contacting condition with the synthetic yarn, wherein twists imparted by a false twisting device disposed downstream of said heater body run back along the length of the yarn;

a heating member for heating a heating wall of said heater body at a high temperature;

yarn guides disposed in a yarn passage surrounded by said heating wall of said heater body;

said heater body and said heating member being respectively divided into at least two pieces from an upstream side to a downstream side of said heat treating apparatus; and said yarn guides being disposed in yarn passages of said upstream heater body and the remaining heater body of said divided heater body;

wherein, when measured along the length of the divided heater body, the distance between corresponding points on adjacent yarn guides of said upstream heater body is less than the distance between adjacent yarn guides of said remaining heater body, and said distance between adjacent yarn guides of the upstream heater body is not greater than 30 mm.

2. An apparatus for heat treating a synthetic yarn according to claim 1, wherein a total length of said heater body is between 0.7 and 1.3 m, and said heater body and said heating member are divided into two pieces from said upstream side to said downstream side of said heat treating apparatus in a ratio of length between 1:3 and 1:1.5.

3. An apparatus for heat treating a synthetic yarn according to claim 1, wherein a total length of said heater body is between 0.8 and 1.2 m, and said heater body and said heating member are divided into two pieces from said upstream side to said downstream side of said heat treating apparatus in a ratio of length between 1:3 and 1:1.5.

4. An apparatus for heat treating a synthetic yarn according to claim 1, wherein a total length of said heater body is between 0.7 and 1.3 m, and said heater body and said heating member are divided into two pieces from said upstream side to said downstream side of said heat treating apparatus in a ratio of length between 1:3 and 1:1.5, and a length of said upstream heater body is between 0.2 and 0.5 m and a length of said downstream heater body is between 0.5 and 0.8 m.

5. An apparatus for heat treating a synthetic yarn according to claim 1, wherein said upstream heating member has means for heating said upstream heater body at a temperature higher than 370° C., and the remaining heating member has means for heating the remaining heater body at a temperature that is either between 200° and 320° C. or higher than 370° C.

6. An apparatus for heat treating a synthetic yarn according to claim 1, wherein said upstream heating member has means for heating said upstream heater body at a temperature higher than 400° C., and the remaining heating member has means for heating the remaining heater body at a temperature that is either between 250° and 320° C. or higher than 400° C.

7. An apparatus for heat treating a synthetic yarn which comprises:

a heater body for at least partially encircling a synthetic yarn in a non-contacting condition with the synthetic yarn, wherein twists imparted by a false twisting device disposed downstream of said heater body run back along the length of the yarn;

a heating member disposed in said heater body for heating a heating wall of said heater body at a high temperature;

yarn guides disposed in a yarn passage surrounded by said heating wall of said heater body;

a total length of said heater body being between 0.7 and 1.3 m;

said heater body and said heating member being respectively divided into two pieces from an upstream side to a downstream side of said heat treating apparatus in a ratio of length between 1:3 and 1:1.5;

said upstream heating member of said divided heating member having means for heating said upstream heater body at a temperature higher than 370° C., and said downstream heating member of said divided heating member having means for heating said downstream heater body at a temperature that is either between 200° and 320° C. or higher than 370° C.;

said upstream heater body having said yarn guides disposed such that the distance between corresponding points on adjacent yarn guides is not greater than 30 mm; and said downstream heater body having said yarn guides disposed such that the distance between corresponding points on adjacent yarn guides is between 80 and 120 mm.

8. An apparatus for heat treating a synthetic yarn according to claim 7, wherein said upstream heating member has means for heating said upstream heater body at a temperature higher than 400° C., and said downstream heating member has means for heating said downstream heater body at a temperature that is either between 250° and 320° C. or higher than 400° C.

9. An apparatus for heat treating a synthetic yarn according to claim 7, including means for heating the upstream and downstream heater bodies such that the temperature of each heater body is outside the range of 320° to 390° C.

10. An apparatus for heat treating a synthetic yarn according to claim 7, wherein said heating members are electric heaters which are connected to a controller for independently controlling heating of said electric heaters of said upstream and downstream heater bodies.

11. An apparatus for heat treating a synthetic yarn according to claim 7, wherein said pitches of said yarn guides disposed on each of said heater bodies are non-equidistant.

12. An apparatus for heat treating a synthetic yarn, the apparatus comprising:

a heater body for at least partially encircling a synthetic yarn without contacting the synthetic yarn, and a false twisting device disposed downstream of said heater body for imparting twists which run along the length of the yarn;

a heating member for heating a heating wall of said heater body at a high temperature;

yarn guides disposed in a yarn passage surrounded by said heating wall of said heater body;

said heater body and said heating member each being respectively divided into at least two pieces disposed on an upstream side and a downstream side of said heat treating apparatus;

means for heating said upstream heater body to a temperature higher than that of the remaining heater body; and said yarn guides being disposed on the upstream heater body of said divided heater body such that the distance between corresponding points on adjacent yarn guides, measured in a direction along the length of the upstream heater body, is not greater than 30 mm, and on the downstream heater body such that the distance between corresponding points on adjacent yarn guides is greater than 30 mm.

13. An apparatus for heat treating a synthetic yarn, the apparatus comprising:

a heater body for at least partially encircling a synthetic yarn without contacting the synthetic yarn, and a false twisting device disposed downstream of said heater body for imparting twists to the yarn which run along the length of the yarn;

a heating member for heating a wall of said heater body at a high temperature;

yarn guides disposed in a yarn passage surrounded by said heating wall of said heater body;

said heater body and said heating member each being respectively divided into at least two pieces, one of which is disposed on an upstream side of said heat treating apparatus; and means for heating said upstream heater body to a temperature higher than that of the remaining heater body;

wherein, when measured along the length of the divided heater body, the distance between corresponding points on adjacent yarn guides of said upstream heater body is less than the distance between corresponding points on adjacent yarn guides of said remaining heater body.

* * * * *

UNITED STATES PATENT AND TRADEMARK OFFICE

CERTIFICATE OF CORRECTION

PATENT NO. : 5,404,705

DATED : April 11, 1995

INVENTOR(S) : Masaaki Yanagihara, et. al.

It is certified that error appears in the above-indentified patent and that said Letters Patent is hereby corrected as shown below:

Col. 2, line 7, after "However," insert -- as --; Col. 2, line 55, delete "used"; Col. 2, line 60, "heating" should be -- heat --; Col. 4, line 30, "overcome" should be -- overcomes --; Col. 5, line 46, "conditions" should be -- condition --; Col. 6, line 2, delete the comma; Col. 6, line 39, "0°" should be -- a --; Col. 8, line 8, after "result" insert a comma; Col. 9, line 68, delete the comma.

Signed and Sealed this

Twelfth Day of December, 1995

*Attest:*

Bruce Lehman

BRUCE LEHMAN

*Attesting Officer*

*Commissioner of Patents and Trademarks*